US005391836A

United States Patent [19]

Bortas et al.

[11] Patent Number: 5,391,836

[45] Date of Patent: Feb. 21, 1995

[54] ELECTRIC CABLE

[75] Inventors: Mats O. Bortas, Bjursas; Lars O. G. Efraimsson; Agne H. Nyberg, both of Falun, all of Sweden

[73] Assignee: Telefonaktiebolaget L M Ericsson, Stockholm, Sweden

[21] Appl. No.: 10,777

[22] Filed: Jan. 29, 1993

[30] Foreign Application Priority Data

Feb. 6, 1992 [SE] Sweden ..... 9200344

[51] Int. Cl.[6] ..... H01B 7/34

[52] U.S. Cl. ..... 174/36; 174/103; 174/106 R; 174/109

[58] Field of Search ..... 174/36, 103, 106 R, 174/109

[56] References Cited

U.S. PATENT DOCUMENTS

| | | | |
|---|---|---|---|
| 2,527,172 | 10/1950 | Beaver et al. . | |
| 4,477,693 | 10/1984 | Krabec et al. | 174/36 |
| 4,598,165 | 7/1986 | Tsai | 174/36 |
| 4,599,483 | 7/1986 | Kuhn et al. | 174/36 |
| 4,639,545 | 1/1987 | Pithouse et al. | 174/36 |
| 4,684,762 | 8/1987 | Gladfelter | 174/36 |
| 4,791,236 | 12/1988 | Klein et al. | 174/36 |
| 4,868,565 | 9/1989 | Mettes et al. | 174/36 |
| 4,970,352 | 11/1990 | Satoh | 174/106 R |
| 5,012,045 | 4/1991 | Sato | 174/106 R |
| 5,118,905 | 6/1992 | Harada | 174/109 |
| 5,216,202 | 6/1993 | Yoshida et al. | 174/36 |

FOREIGN PATENT DOCUMENTS

| | | | |
|---|---|---|---|
| 1096453 | 2/1981 | Canada . | |
| 0142050 | 5/1985 | European Pat. Off. . | |
| 943611 | 3/1949 | France | 174/103 |
| 2419843 | 4/1974 | Germany . | |
| 105806 | 5/1991 | Japan | 174/36 |
| 219025 | 2/1968 | Sweden . | |
| 315643 | 10/1969 | Sweden . | |
| 330191 | 11/1970 | Sweden . | |
| 372994 | 1/1975 | Sweden . | |
| WO90/12407 | 10/1990 | WIPO . | |

*Primary Examiner*—Morris H. Nimmo
*Attorney, Agent, or Firm*—Burns, Doane, Swecker & Mathis

[57] ABSTRACT

The present invention relates to an electric cable which includes at least one cable part and at least one shield which surrounds at least one cable part, and which further includes a plastic or a rubber sheath which embraces the cable part or parts and the shield, wherein each cable part includes a conductor made of copper wire or some other electrically conductive material, and a plastic or a rubber insulating layer. According to the invention, the shield is comprised of one or more prefabricated, woven or braided bands which are placed longitudinally around the cable part or parts. The total width of the shield band or bands can be larger than the perimeter of the underlying construction to allow an overlap of the shield. Different diameters of wire in the shield allow interlocking of the shield about the cable part.

13 Claims, 4 Drawing Sheets

Fig. 6
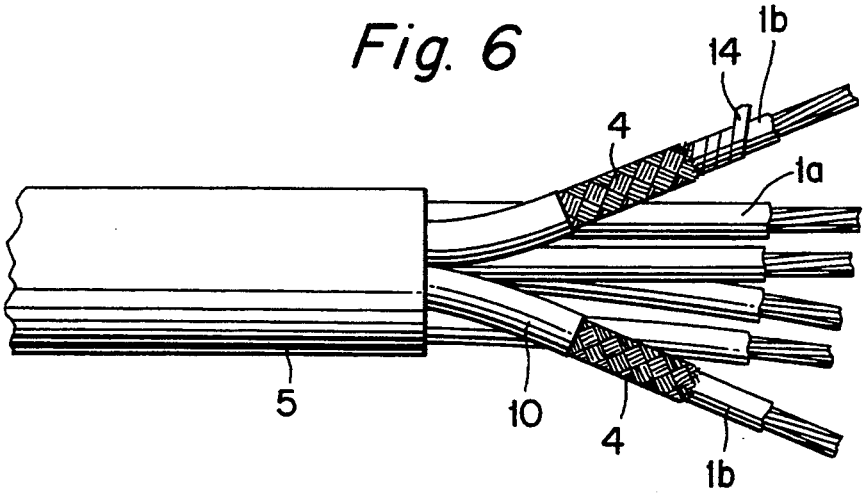
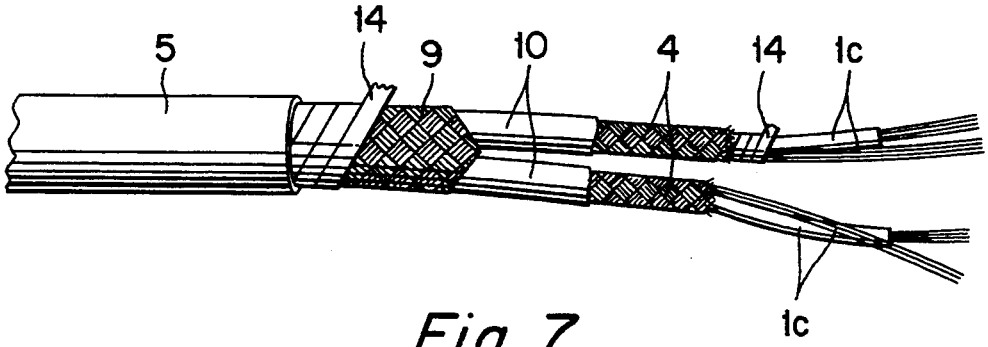
Fig. 7

ELECTRIC CABLE

TECHNICAL FIELD

The present invention relates to an electric cable which includes at least one cable part, at least one shield or screen which surrounds said at least one part, and a plastic or a rubber sheath, which surrounds said part or said parts and the shield. Each cable part includes an electrical conductor made of copper wire or other conductive material, and a plastic or a rubber isolating layer.

BACKGROUND ART

Shielded cables are used in environments in which there is a risk of electrical and/or magnetic disturbances occurring. The shield construction, and therewith also the function of the shield, will thus depend on the environment from which the cable shall be protected, i.e. shielded, against.

The simplest shielded cable is a so-called coaxial cable which comprises an insulated conductor or cable part which is surrounded by a shield of spirally-wound wires or a braided shield or screen. The shield is embraced by cable sheathing. The effectiveness of the shield can be further enhanced by placing metal foil between said cable part and the shield and/or between the shield and the cable sheathing.

When shielding cables by means of spirally-wound wires, it may be difficult to maintain a sufficient tightness or compactness of the shield when bending the cable for instance, since bending of the cable will cause the shield wires to slide apart on the outer surface of the cable bend. The shielding function is thus impaired at these locations, which is naturally a disadvantage.

Braided shields are comprised of a large number of wires which are placed in accordance with a given pattern. Such shields are encumbered with many manufacturing drawbacks. One of the main drawbacks resides in difficulties in achieving continuous production, as a result of the necessity to stop production in order to effect requisite wire changes. In addition, braiding is a relatively slow process and is therefore usually carried out in a separate production step.

Another drawback resides in connecting the braiding. After having stripped the cable, a sleeve is pressed in beneath the braiding when making a crimp connection of some similar connection. Because of the configuration of the braiding this may be difficult to achieve at times, among other things due to difficulty in inserting the sleeve to the shield.

Another drawback with braided shields is that connection of the shield to an electric contact is effected separately. When stripping the cable, the braided shield is loosened from said cable part or parts and then cut and shaped into a separate conductor. This task is both difficult and time-consuming and there is also a risk that the cable part or cable parts will be cut and therewith damaged.

SUMMARY OF THE INVENTION

The present invention provides an alternative method of shielding a cable of the aforesaid kind which leads to improved qualities from a process, shielding and handling aspect. The invention provides a novel shield which has the same electrical properties as a braided shield but which affords further positive effects from a process and handling aspect in particular.

According to the invention, the shield is comprised of one or more bands which may be prefabricated, such as woven or braided bands which comprise (tinned) copper wires, optionally with transversely extending connecting wires of some other material. The longitudinally extending wires may be comprised of material other than copper.

The shielding band or bands is/are laid in the direction of the longitudinal axis of the cable. The width of the band shall be at least equal to the circumference of the construction beneath the shield, when good shielding ability is desired. The shielding function is further enhanced when the ends of the band overlap one another. A gap can be allowed between the band turns in the case of flexible, concentric cables where good shielding is not a requisite, i.e. a space may be permitted between the edges of the band turns. With regard to these applications, the band or bands is/are dimensioned so that mechanical, electrical and personal safety requirements are fulfilled.

When a woven band is used, the band may be configured in various ways. The wires present in the band need not have the same diameter, in accordance with the following:

- All longitudinally extending wires will have mutually the same diameter. Among other things, this will afford the advantage of the overlap being visible, which may be an advantage when making an electrical connection.
- The embracing wires may have a larger diameter than the overlap wires. This provides the advantage of a smaller diameter at the overlap and a smoother cable.
- Combination of different wire diameters so as to achieve a more positive locking of the shield at the overlap, among other things.

The function of the transverse wires is adapted so that:

- The shield will possess an effective shielding ability.
- The band construction is held together.
- The band shield is flexible.

All longitudinally extending shield wires will preferably extend in the axial direction of the cable, i.e. parallel with said axis. This ensures that no conduction losses are experienced due to the pitch of the shield wires. This enables the shield area to be equally as large as the conduction area, when desired.

When a braided band is used, the braids are adapted to shielding requirements and electrical properties:

- Higher shielding demands require a tighter or denser braid.
- The braiding may have the same electrical properties as the conductor.

The invention will now be described in more detail with reference to a preferred exemplifying embodiment thereof and also with reference to the accompanying drawings.

BRIEF DESCRIPTION OF THE DRAWINGS

FIGS. 6 and 7 show shielding alternatives with different types of cables having several cable parts and provided with shields configured in accordance with the invention.

DETAILED DESCRIPTION OF THE PREFERRED EMBODIMENTS

Figure 1:
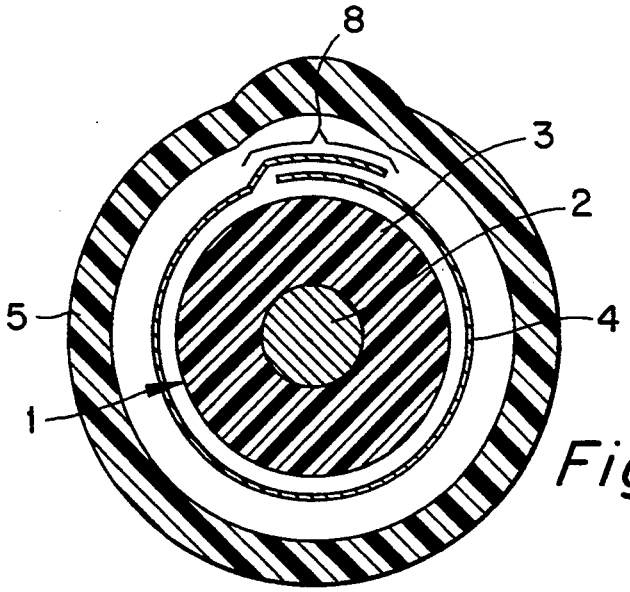
FIG. 1 is a cross-sectional view of a cable comprising a cable part and a surrounding shield constructed in accordance with the invention, a so-called coaxial cable.

FIG. 1 is a cross-sectional view of a cable having solely one cable part 1 and a shield 4 which is constructed in accordance with the invention and which embraces said one part, i.e. a so-called coaxial cable. It will be understood that the cable may include several parts, of which each part or only some parts is/are embraced by an inventive shield, and also that the parts of multi-part cables can be embraced by respective further shields, as explained in more detail herebelow. Each cable part 1 includes a conductor 2 which may consist of copper wire or some other electrically conductive material, which is optionally tinned, and an insulating layer 3 comprised of a plastic or a rubber material or a mixture of said materials, optionally halogen-free. The cable is provided externally with a protective, holding sheath or jacket 5 which is comprised of an insulating layer of plastic or rubber material, or a mixture of these materials, optionally halogen-free.

According to the present invention, the shield 4 is comprised of one or more bands which may be prefabricated, such as woven or braided bands. The bands are made of copper wire, which may optionally be tinned, or some other suitable electrically conductive material. The shield band or bands 4 is/are laid longitudinally. In the preferred embodiment of FIG. 1, only one band is used and it is assumed that good shielding is the main requirement. The width of the band 4 shall be at least equal to the perimeter of the construction beneath the shield, i.e. the perimeter of the cable part 1 in FIG. 1. The shielding function is further enhanced when the ends or sides of the band overlaps, i.e. when the band forms the overlap 8 shown in FIG. 1.

Figure 4:
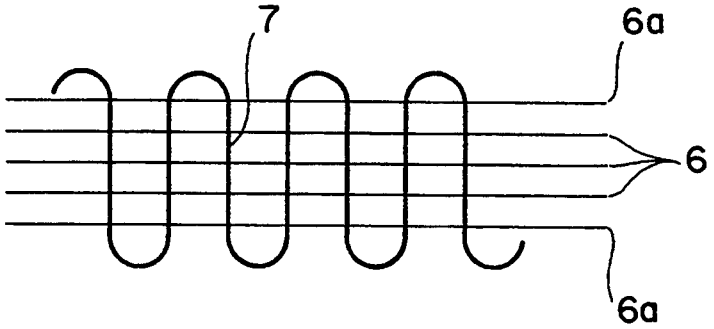
FIG. 4 is a schematic illustration of the construction of the shielding band.

In the case of a woven band, shown in more detail in FIG. 4, the band is constructed of longitudinally extending wires 6 which are held together by transverse, connecting wires 7, these wires optionally comprising a material different from the longitudinally extending wires 6. When a woven shield band 4 is used, all longitudinally extending wires 6 may have one and the same diameter. Among other things, this has the advantage that the overlap can be seen, as shown in FIG. 1. This may be an advantage when making electrical contact.

Figure 2:
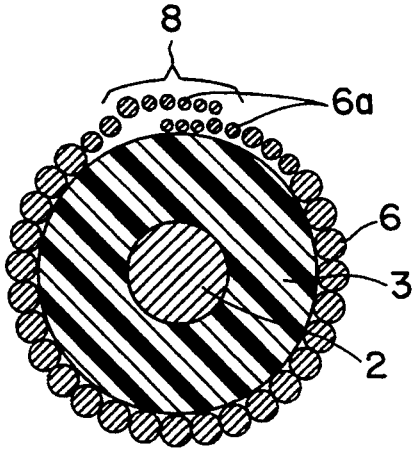
FIG. 2 illustrates an alternative embodiment of the shield with an invisible overlap.

FIG. 2 illustrates an alternative embodiment of the shield band 4 in which the longitudinally extending threads 6 which "cover" the perimeter of the construction, i.e. the perimeter of the cable part 1 lying beneath the shield, have a diameter which is larger than the overlapping, longitudinally extending wires 6*a* along the side edges of the shield band 4. The shield band 4 may also be provided with wires whose diameters decrease successively out towards the side edges. The advantage afforded hereby is that the diameter of the cable will be smaller at the overlap and that the cable will be smoother, among other things.

Figure 3A:
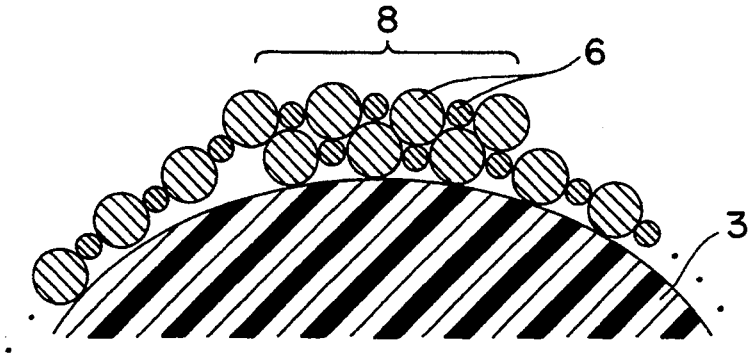
FIGS. 3*a* and 3*b* illustrate a further alternative of the inventive shield with a locking overlap.
Figure 3B:
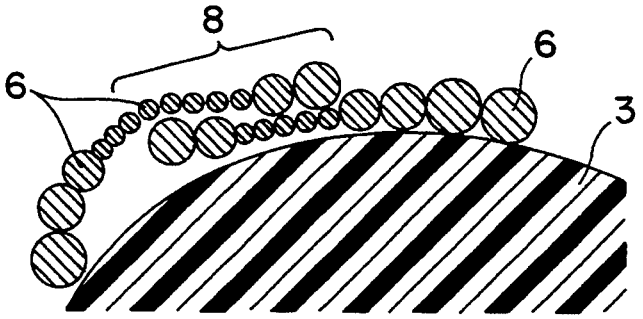

FIGS. 3*a* and 3*b* illustrate a combination of longitudinally extending wires of mutually different diameters. Among other things, the combination provides the advantage that the overlap obtains a locking function, because the longitudinally extending wires of larger diameter along one side edge of the band 4 "hook firmly" in the spaces between longitudinally extending wires of smaller diameter along the other side edge of the band 4. The combination also provides the advantage of a smaller cable diameter at the overlap.

Figure 5:
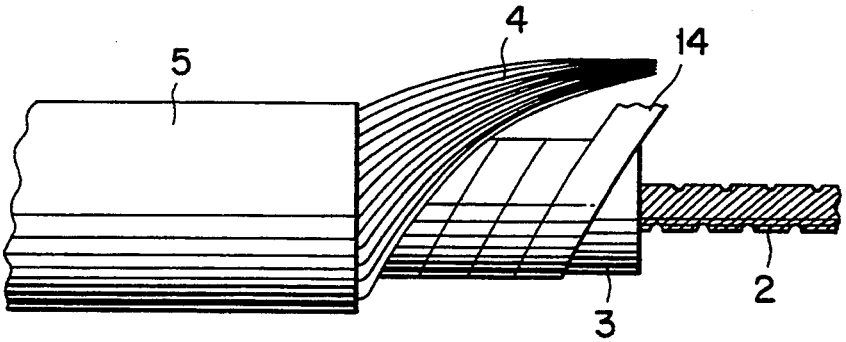
FIG. 5 illustrates schematically the shielding band formed to provide an electrical connection.

FIG. 5 illustrates a shield band 4 constructed in accordance with the invention and having the important advantage that, as a result of the band construction, an electric connection or electric contact can be readily achieved by twisting the shield band to form a separate conductor after stripping the cable sheath. This is difficult and time-consuming to achieve with a braided shield of conventional construction, because a braided shield must be sliced or cut and then folded to form a conductor. In addition, there is a risk that the cable parts will be damaged when cutting the shield.

The shield construction may have a double function in the case of coaxial cables. In this case, the shield band will function as an electric conductor and also as a shield. By electric conductor is meant here that the conductor formed by said cable part and the shield band shall have roughly the same areas, or areas which are sufficiently large to ensure that the conductor function of the shield band will be realized. The shielding ability of the shield band is adapted to the physical tightness of the band.

When greater demands are placed on the shielding ability of the shield, or when a more tightly wound or denser shield is desired, the shield construction can be complemented with metal foil 14, as shown in FIGS. 5, 6, and 7. The metal foil is placed between cable part and shield and/or between shield and cable sheath, and preferably consists of a pure Al-foil, Al-coated plastic foil, a pure Cu-foil, Cu-coated plastic foil or a $\mu$-metal foil. The metal side is preferably turned to face the shield band. When the metal foil lies between the cable part and the shield band, the metal foil has the dual function of shielding the cable and of providing a solder guard when connecting solder contacts to the shield.

The shield construction is sheathed or banded so as to hold the shield band together. The sheathing consists of an insulating layer of a plastic or a rubber material, or a mixture of these materials, optionally halogen-free. Banding is effected with a plastic band or a metal foil, in accordance with the aforegoing. As before mentioned, the shield 4 may comprise more than one prefabricated, braided or woven band. In those applications where a good shielding effect is primarily required, the shield bands 4 are also configured so that their total width will be at least equal to or exceed the perimeter of the underlying construction. The bands 4 are preferably configured according to any one of the alternatives described above with reference to FIGS. 1–4 at the overlap 8. However, if the desired shielding effect is not as great as in the former case, for instance when flexible, concentrical cables are to be shielded, a gap or an interspace can be permitted between the shield bands, or between the opposing band-edges when only one shield band is used. In these applications, the shield band or bands is/are dimensioned so as to fulfill demands on personal safety and mechanical and electrical requirements.

A number of construction applications in which the shield band can be used are described below with reference to FIGS. 6 and 7. FIG. 6 illustrates a construction which includes both unshielded cable parts 1*a* and individually shielded cable parts 1*b*, whereas FIG. 7 illustrates a construction which includes twisted shielded parts 1*c* and a further shield 9 which lies outside said shielded cable parts 1*c*. The Figures shall be seen merely as an example and it will be understood that other combinations are conceivable. The areas of use are individually shielded cable parts, shielded pair-twisted cables, etc.

The shield construction is, in all cases, produced in accordance with any one of the aforedescribed alternatives, including the outer shield 9. In order to hold the shield band (or bands) together, the band/bands is/are banded with a plastic band 10 or the like. When high demands are placed on the shielding or screening ability of the shield band, the holding band 10 may consist of metal foil, in accordance with the aforegoing.

Several positive effects are obtained when connecting the aforesaid constructions electrically. In the case of crimp connections, a crimping sleeve can be inserted readily beneath the shield band 4, owing to the fact that the overlapping parts of the shield band will naturally move apart. Separate connection of the shield band 4 can be effected very simply. After stripping the cable of its sheathing, the shield band can be readily separated from the cable part, in accordance with FIG. 5, without requiring the use of special tools (with the risk of damaging said cable part), and can be connected to an electrical contact. Because the shield can be readily formed into a conductor, the electric contact construction can be formed in a correspondingly simple manner.

Figure 8:
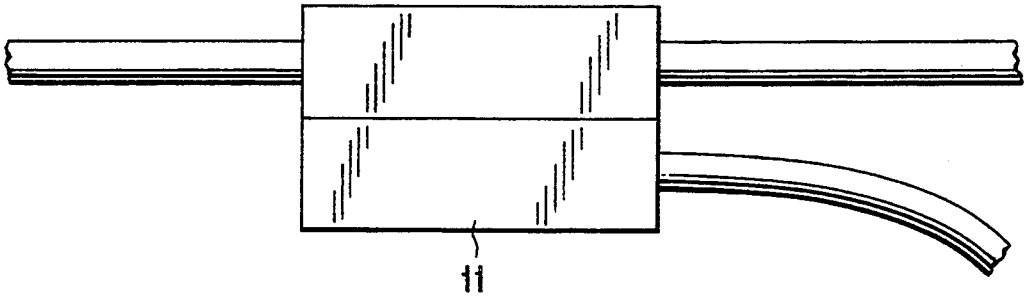
FIG. 8 illustrates in principle how a T-coupling can be made on a cable constructed in accordance with the invention.
Figure 9:
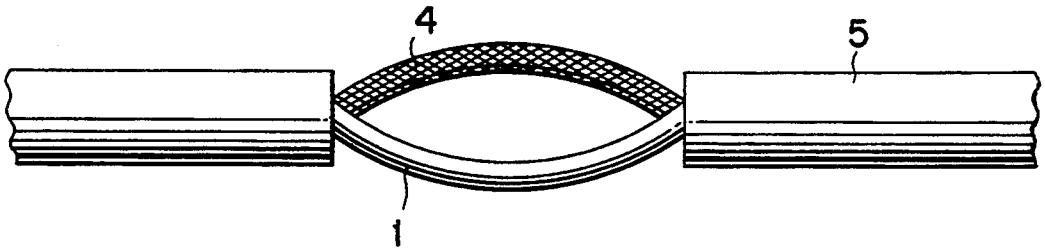
FIG. 9 illustrates a step in the connection of a T-coupling according to FIG. 8.
Figure 10:
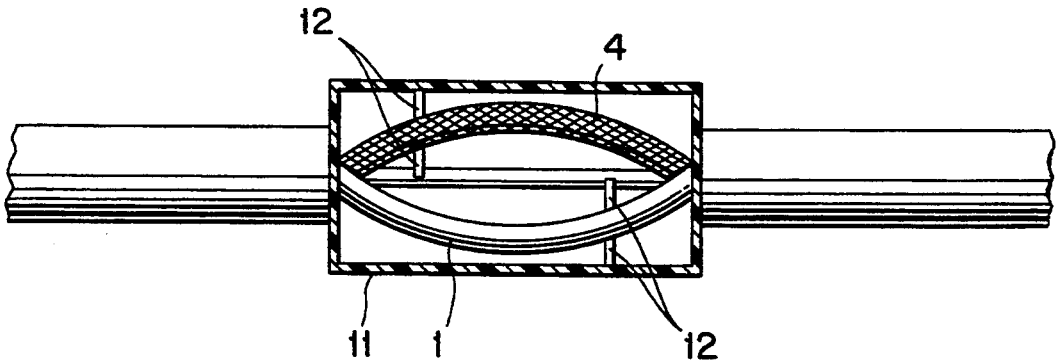
FIG. 10 illustrates the connection of the cable shown in FIG. 9 to one-half of the T-coupling.

Another positive effect that is achieved with the present invention is illustrated in FIGS. 8 to 10. An outlet, a so-called T-coupling, can be readily formed on a cable provided with an inventive shield construction, by peeling-off a section of the sheathing 5 and then gathering the shield band 4 together, without damaging the band, to form a separate conductor, as illustrated in FIG. 9, which is separate from the cable part 1 (or the cable parts). The shield band 4 and the cable part 1 are then inserted into separated "compartments", which are insulated from one another, in one-half of the T-coupling 11, as illustrated in FIG. 10. Coupling tags (not shown) inserted in the slots 12 function to connect the shield 4 and the cable part 1 respectively to a corresponding shield and cable part in the other half of the T-coupling, which is constructed in the same fashion but with the exception that in this case the cable arrives solely from one direction, as shown in the lower part of FIG. 8.

Other positive, process/technical advantages and effects are achieved in the production of the aforesaid shield constructions. The total production rate can be raised, because the band is prefabricated. One production step is eliminated, which enables, for instance, a cable according to the above to be manufactured in one single manufacturing step.

It will be understood that the invention is not restricted to the aforedescribed and illustrated embodiments, and that modifications can be made within the scope of the following claims.

We claim:

1. An electric cable which includes at least one cable part, at least one shield which surrounds said at least one cable pan, and an insulating cable sheath which surrounds said at least one cable part and said at least one shield, wherein each cable part includes a conductor made of an electrically conductive material, and an insulating layer, and wherein the at least one shield is comprised of at least one prefabricated band and is placed longitudinally around the at least one cable part, the at least one shield band is comprised of longitudinally extending wires and transverse holding wires, a width of the at least one shield band is greater than the perimeter of the at least one cable part so as to form overlapping wires, and the overlapping wires which extend longitudinally along the side edges of the at least one shield band have a smaller diameter than non-overlapping wires.

2. An electric cable which includes at least one cable part, at least one shield which surrounds said at least one cable part, and an insulating cable sheath which surrounds said at least one cable part and said at least one shield, wherein each cable part includes a conductor which is made of an electrically conductive material, and an insulating layer, and wherein the at least one shield is comprised of at least one prefabricated band and is placed longitudinally around the at least one cable part, the at least one shield band is comprised of longitudinally extending wires and transverse holding wires, a width of the at least one shield band is greater than the perimeter of the at least one cable pan so as to form a first layer and a second layer of longitudinally extending wires in an overlap region, at least two of said first layer longitudinally extending wires in said overlap region having diameters different from each other and at least two of said second layer longitudinally extending wires in said overlap region having diameters different from each other so as to obtain a locking effect in the overlap region.

3. An electric cable which includes several cable parts, a first shield which surrounds a first pair of said several cable parts and does not surround a second pair of said several cable parts, a second shield which surrounds the first and second pairs of said several cable parts, metal foil, and an insulating cable sheath which surrounds said several cable parts and said first and second shields, wherein each cable part includes a conductor which is made of an electrically conductive material, and an insulating layer, and wherein the first shield is comprised of a first prefabricated band and is placed longitudinally around the first pair of cable parts, the second shield is comprised of a second prefabricated band and is placed longitudinally around the first and second pairs of cable parts inwardly of the cable sheath, the metal foil is placed between the cable sheath and the second shield band, and a width of the first shield band is substantially as large as the perimeter of the first pair of cable parts.

4. An electric cable comprising:

a conductor;

first insulating means for longitudinally covering said conductor;

shielding means for longitudinally surrounding said first insulating means and having a width greater than an outer perimeter of said first insulating means to allow a longitudinal overlap region of said shielding means, said shielding means comprising plurality of longitudinally extending wires engaging at least one transverse holding wire wherein said longitudinally extending wires substantially within said overlap region have smaller diameters than said longitudinally extending wires not substantially within said overlap region.

5. The electric cable of claim 4 wherein said shielding means are prefabricated.

6. The electric cable of claim 4 wherein a perimeter of said shielding means longitudinally surrounding said first insulating means is substantially smooth.

7. The electric cable of claim 4 further comprising a second insulating means for longitudinally covering said shielding means.

8. An electric cable comprising:

a conductor;

first insulating means for longitudinally coveting said conductor;

shielding means for longitudinally surrounding said first insulating means and having a width greater than an outer perimeter of said first insulating means to allow a longitudinal overlap region of said shielding means, said shielding means comprising plurality of longitudinally extending wires engaging at least one transverse holding wire wherein said longitudinally extending wires substantially within said overlap region have mutually different diameters to allow interlocking of said longitudinally extending wires at said overlap region.

9. The electric cable of claim 8 wherein said longitudinally extending wires substantially within said overlap region have smaller diameters than said longitudinally extending wires not substantially within said overlap region.

10. The electric cable of claim 9 wherein a perimeter of said shielding means longitudinally surrounding said first insulating means is substantially smooth.

11. The electric cable of claim 9 wherein said shielding means are prefabricated.

12. The electric cable of claim 8 wherein said shielding means are prefabricated.

13. The electric cable of claim 8 further comprising a second insulating means for longitudinally covering said shielding means.

* * * * *